US006575738B1

(12) United States Patent
Nguyen et al.

(10) Patent No.: US 6,575,738 B1
(45) Date of Patent: Jun. 10, 2003

(54) COMPOSITE REFRACTORY INSULATING TILE

(76) Inventors: Carole S. Nguyen, 14761 Nicole Dr., North Huntingdon, PA (US) 15642; Ngoc N. Nguyen, 14761 Nicole Dr., North Huntingdon, PA (US) 15642

( * ) Notice: Subject to any disclaimer, the term of this patent is extended or adjusted under 35 U.S.C. 154(b) by 0 days.

(21) Appl. No.: 10/222,659

(22) Filed: Aug. 16, 2002

(51) Int. Cl.[7] ..... F27D 3/02
(52) U.S. Cl. ..... 432/234; 138/149; 432/233
(58) Field of Search ..... 432/123, 234, 432/247, 251, 264, 233; 138/137, 149

(56) References Cited

U.S. PATENT DOCUMENTS

| | | | | |
|---|---|---|---|---|
| 3,881,864 A | | 5/1975 | Nicol | 432/234 |
| 3,891,006 A | | 6/1975 | Lee | 138/106 |
| 4,015,636 A | | 4/1977 | Van Fossen | 138/149 |
| 4,070,151 A | | 1/1978 | Suey | 432/234 |
| 4,071,311 A | | 1/1978 | Errington | 432/234 |
| 4,140,484 A | | 2/1979 | Payne | 432/234 |
| 4,225,307 A | | 9/1980 | Magera | 432/234 |
| 4,330,266 A | | 5/1982 | Suey | 432/234 |
| 4,393,569 A | | 7/1983 | Byrd, Jr. | 29/460 |
| 4,424,027 A | | 1/1984 | Suey | 432/233 |
| 4,427,187 A | | 1/1984 | Denis | 266/274 |
| 4,450,872 A | | 5/1984 | Orcutt | 138/149 |
| 4,539,055 A | | 9/1985 | Orcutt | 156/92 |
| 4,906,525 A | | 3/1990 | Seguchi et al. | 428/469 |
| 5,154,605 A | | 10/1992 | Suey | 432/234 |
| 6,000,438 A | | 12/1999 | Ohrn | 138/149 |
| 6,102,694 A | * | 8/2000 | Lenz | 432/234 |
| 6,152,087 A | * | 11/2000 | Shibata et al. | 122/512 |
| 6,179,610 B1 | | 1/2001 | Suey et al. | 432/233 |

* cited by examiner

*Primary Examiner*—Gregory Wilson
(74) *Attorney, Agent, or Firm*—Armstrong, Westerman & Hattori, LLP

(57) ABSTRACT

A pair of composite refractory tiles for insulating fluid-cooled structural members of a metallurgical furnace of the type for re-heating metal billets and slabs. The refractory tiles are a composite of a cast refractory shell which extends radially from an outer surface of the tile inward, at selected portions, to an inner surface for contacting the furnace member. In portions of the refractory tile, where contact with the furnace member is not made, a ceramic fiber insulating blanket fills a hollow between the cast refractory shell and the furnace member. Incorporating the ceramic fiber insulating blanket into each tile decreases furnace heat loss as compared to solid cast refractory tiles of comparable thickness. Attachment assemblies, which contact the fluid-cooled structural members, have a plurality of spaced anchoring wires which extend into the cast refractory shell and maintain proper alignment of each tile with the furnace structural member. The plurality of anchoring wires extend solely into portions of the cast refractory shell whereat the cast refractory extends solidly from the outer surface of the tile to the inner surface for contacting the furnace member.

26 Claims, 14 Drawing Sheets

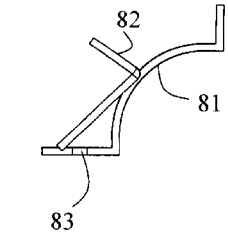
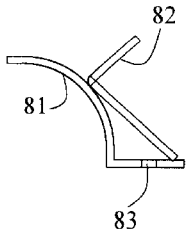
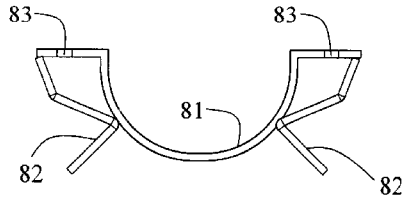
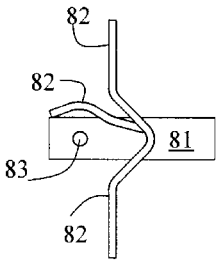
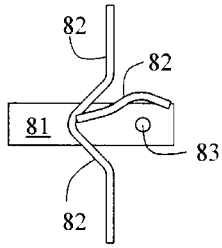
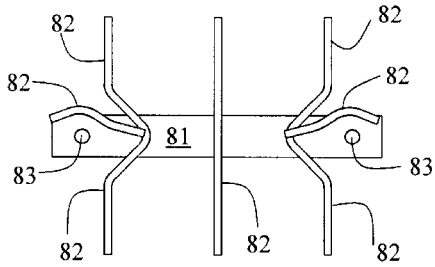
FIG. 12a FIG. 12b FIG. 12c
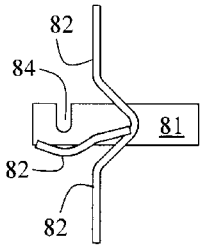
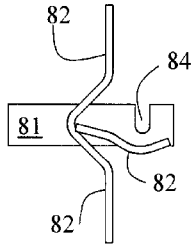
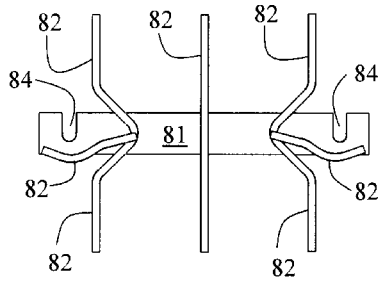
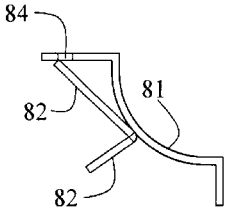
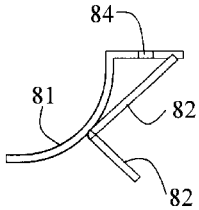
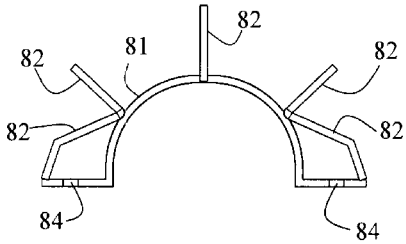
FIG. 12d FIG. 12e FIG. 12f

COMPOSITE REFRACTORY INSULATING TILE

BACKGROUND OF THE INVENTION

1. Field of the Invention

This invention relates to metallurgical furnaces of the type used to reheat metal prior to hot working, wherein certain water-cooled furnace members are covered with refractory material so as to insulate and protect them from hot furnace gases.

2. Description of Related Art

Furnaces for heating metal during processing often operate at temperatures up to about 2400° F. At such elevated temperatures it is necessary to protect furnace structural members from such intense heat. Furnace members providing support for heavy metal sections, such as billets or slabs being heated in such furnaces, are insulated and are cooled internally with circulating fluid so as to maintain the strength required to support the weight of the heavy metal sections.

Furnace support members for heavy metal sections, commonly referred to as skid rails, typically consist of horizontally oriented water cooled pipes having an upwardly projecting wear surface along their length. The heavy metal sections, which are to be heated, are slid along the wear surfaces of such support members as they move from the furnace entrance to the furnace exit. Insulation for the support members is commonly of a single refractory material or can be made up of concentric layers of different materials and are referred to as refractory tiles. A multitude of different means are employed to secure the refractory tiles to the furnace members in a manner to withstand the high temperature, thermal shock, vibration, and other forces to which the furnace members and refractory tiles are subjected. Relative ease of installation is of importance, due to the requirement for periodic replacements.

U.S. Pat. No. 4,424,027 describes a refractory tile in which an access hole is provided for use in welding an embedded channel to a fluid cooled furnace member with the use of a mig-welder.

U.S. Pat. No. 3,881,864 describes a refractory tile surrounding an inner fibrous refractory material about a furnace skid rail wherein two complimentary c-shaped blocks interengage beneath the skid rail to secure the insulation in place. No additional means is provided for attachment.

U.S. Pat. No. 4,393,569 describes a module wherein the support member is wrapped with refractory fiber insulating material which is protected by an outer refractory ceramic fiber blanket which is folded into at least two layers.

U.S. Pat. No. 4,140,484 describes a tubular supporting member sheathed by refractory sheathing comprising an inner layer of fibrous refractory material and an outer layer of refractory tiles held in place by metal links which are secured together around the supporting members.

U.S. Pat. No. 4,071,311 describes a metal tubular supporting member sheathed by an inner layer of refractory fibrous material and an outer layer consisting of pairs of semi-cylindrical refractory tiles. The refractory tiles are held in place by metal coupling links covered and positively engaged by adjacent tiles.

U.S. Pat. No. 4,015,636 describes a three-layer insulating assembly comprising an inner fibrous thermal insulation, an intermediate split ceramic refractory, and an outer protective ceramic covering.

U.S. Pat. No. 4,450,872 describes a covering comprising an inner layer of thermal insulating ceramic refractory fiber blanket, an open weave ceramic cloth about the blanket, an inner layer of veneering mortar, compressed rings of ceramic fiber material, and a hot face layer of veneering coating.

U.S. Pat. No. 3,881,864 describes a refractory tile for sheathing a furnace member, preferably around an inner layer of fibrous refractory material. "C" shaped complimentary tiles inter-engage each other underneath the member to hold them in position.

In an improvement over refractory tiles having insulation in concentric layers of different materials, U.S. Pat. No. 6,179,619 describes a composite refractory tile for metallurgical furnace members having layered refractory materials wherein a cast refractory material extends from the furnace member being insulated, to an external surface of the refractory tile at selected portions of the tile located at individual attachment means and near ends of each tile. The composite refractory tile of U.S. Pat. No. 6,179,610 is shown in FIG. 13, in a cross-sectional view perpendicular to a longitudinal direction of the tile. The view is taken in a portion of the tile in which an attachment means is provided. In FIG. 14, the same composite refractory tile is shown in a cross-sectional view in a plane which includes the longitudinal axis 108 of the tile. In FIGS. 13 and 14, water cooled member 101 is insulated with composite refractory tile sections 102, 102 which are made up of cast refractory portions 103 and insulating ceramic fiber blanket portions 104. In the portions surrounding a metal attachment means 105, the cast refractory material extends continuously from fluid-cooled furnace member 101 to outer surface 106 of the tile. Each of the metal attachment means 105 is independent of any of the other attachment means as far as any rigid metal connecting means is concerned. The attachment means can be welded to the fluid cooled furnace member 101 with use of a mig-welder, with access through access holes 107.

In the composite refractory tile of U.S. Pat. No. 6,179,610, the superior insulating properties of the ceramic fiber blanket 104 are utilized in all portions of the tile in which the superior rigidity properties of the cast refractory 103 are not needed. The cast refractory 103 is relied on for centering the tile 102 on the cooled furnace member 101 and for providing a location for embedding anchoring wires 109 which are part of the attachment means 105 which are relied on for holding the tile 102 in place on furnace member 101. In the preferred method of installation welding base 110 of attachment means 105 is welded to furnace member 101. Anchoring wires 109 are attached to welding base 110 through flat washer 111.

As shown in FIG. 13, the anchoring wires 109 extend, in the cast refractory material, radially away from furnace member 101, and then extend in the longitudinal direction of the furnace member. As shown in FIG. 14, other anchoring wires 109 extend, in the cast refractory material, radially away from furnace member 101, and then in a direction generally perpendicular to the longitudinal direction of the furnace member.

As can be seen in FIGS. 13 and 14, end portions of the anchoring wires 109 are disposed in the cast refractory portions which have the better insulating ceramic fiber blanket 104 disposed radially inward. It has been found that having the end portions of the anchoring wires 109 at those locations subjects those end portions to higher temperatures than portions of the anchoring wires which have the cast refractory material disposed radially inward the entire distance from the outer surface 106 of the tile 102, to the inner surface of the tile which contacts the furnace member 101, such as at 113 and 114 of FIG. 13 and FIG. 14 respectfully. Exposure of the anchoring wires to a higher temperature, and the differential in temperature along the length of the anchoring wires lead to a decrease in the useful life of the composite refractory tile.

It is an object of the present invention to provide a composite refractory tile in which the temperature of the anchoring wire is at a reduced temperature (relative to an anchoring wire of the above-described prior art tile installed in a furnace operating at the same temperature), and to reduce the difference in temperature along the length of the anchoring wire.

SUMMARY OF THE INVENTION

The present invention provides a pair of composite refractory tiles for insulating fluid-cooled structural members of a metallurgical furnace. Each tile has a rigid cast refractory shell adapted to be disposed about a portion of the fluid-cooled furnace member, with the shell having an inner face and an opposed outer face, opposed end walls corresponding to the longitudinal direction of the elongated fluid-cooled furnace member, and two edge walls extending between the end walls. The inner face has selected portions for contacting the fluid-cooled furnace member, and remaining portions for being radially spaced from the fluid-cooled furnace member and thereby defining a hollow. A ceramic fiber blanket is disposed within the hollow, the material of the ceramic fiber blanket having a higher insulating k value than material of the cast refractory shell. At least one attachment means is disposed in selected portions of the rigid cast refractory shell, each of the attachment means is so constructed and arranged so as to be disposed within portions of the cast refractory shell having temperatures lower, when in use, than temperatures of remaining portions which are radially spaced from the fluid-cooled furnace member and have the ceramic fiber blanket disposed in the defined hollow.

Other specific features and contributions of the invention are described in more detail below with reference being made to the accompanying drawings.

BRIEF DESCRIPTION OF THE DRAWINGS

FIGS. 12*a*–12*f* are plan and edge views of various attachment assemblies for use in attaching composite refractory insulating tiles of the invention in a non-welding manner;

DETAILED DESCRIPTION OF THE INVENTION

Figure 1:
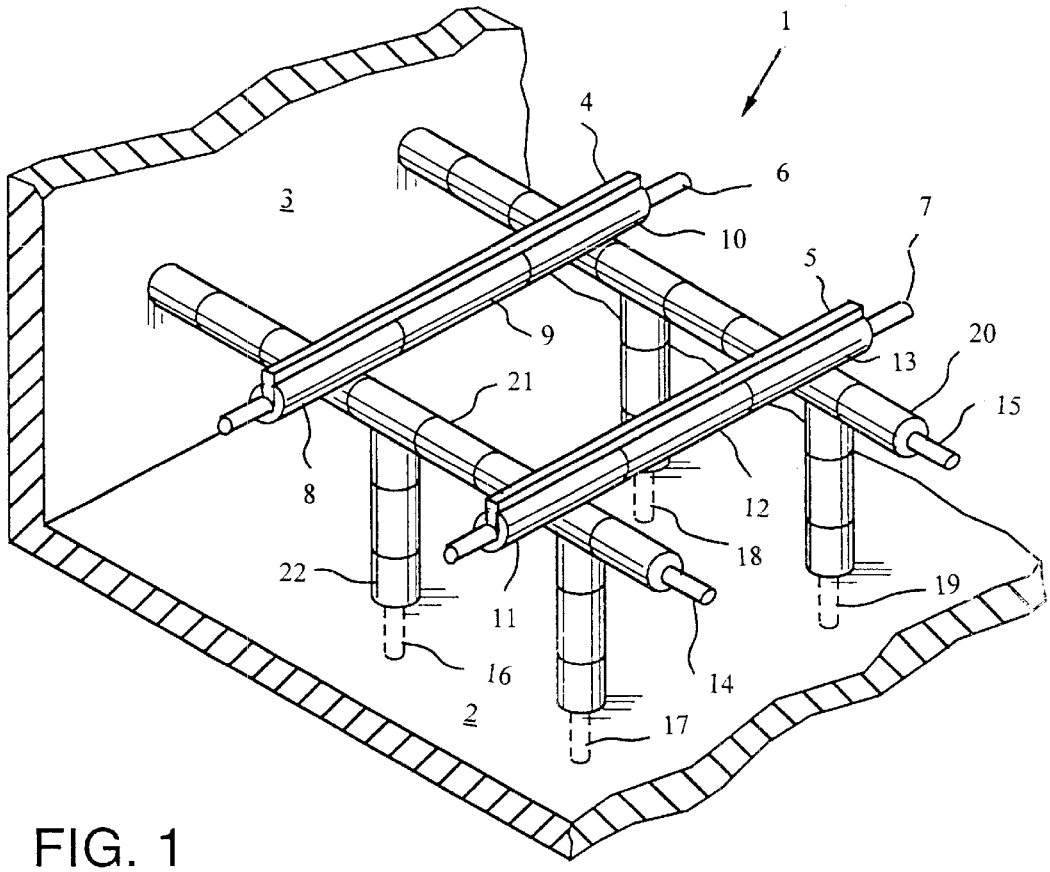
FIG. 1 is a perspective view of the general layout of water cooled supporting members in a metallurgical re-heat furnace.

FIG. 1 depicts a partial section of a metallurgical furnace 1 for use in re-heating heavy metal sections such as slabs or billets prior to a hot working operation such as hot rolling. Temperatures up to about 2400° F. are encountered in a furnace of this type and cooling of structural members subjected to hot furnace gases is required. The invention is described, for the most part, for use with structural members of a furnace of that type having cylindrically shaped internally water cooled pipes, however embodiments for use with fluid-cooled furnace members having other cross sectional shapes are not to be excluded.

In furnace 1, refractory floor 2 and wall 3 make up a portion of a furnace enclosure for containing hot furnace gases. Heavy metal sections to be heated are slid along solid metal skid rails 4 and 5 which project from horizontally oriented fluid-cooled furnace members 6 and 7 respectively, which are insulated from the furnace gases by pairs of composite refractory insulating tiles of the invention. Tiles 8, 9 and 10 cover fluid-cooled member 6 and tiles 11, 12 and 13 cover fluid-cooled furnace member 7. Fluid-cooled furnace members 6 and 7, incorporating the skid rails, are supported by horizontally oriented fluid-cooled furnace members 14 and 15, which are absent any skid rails, and in turn fluid-cooled furnace members 14 and 15 are supported by vertically oriented fluid-cooled furnace members 16, 17, 18 and 19. Composite refractory insulating tiles also cover the supporting members absent the skid rails, for example tile 20 on member 15 and tile 21 on member 14. Vertically oriented members 16, 17, 18 and 19 are also covered with tiles, for example tile 22 on member 16. All of the aforementioned fluid-cooled furnace members are cooled by internally flowing water or other fluid so as to maintain the temperature of the members at a level at which they are structurally capable of supporting the heavy metal sections being heated and slid along the skid rails 4 and 5. In a "walking beam" furnace, for example, it is possible to have two fluid-cooled furnace members disposed parallel to each other and in close proximity to each other (not shown), which can be protected with single tiles having openings for the two members, as described below. The composite refractory insulating tiles of the invention significantly reduce heat loss from the furnace to the circulating coolant while also providing a protective outer shell to resist the harsh environment of the furnace, consisting of the furnace gases and/or slag, scale and debris from the surfaces of the heavy metal sections being heated.

Figure 2:
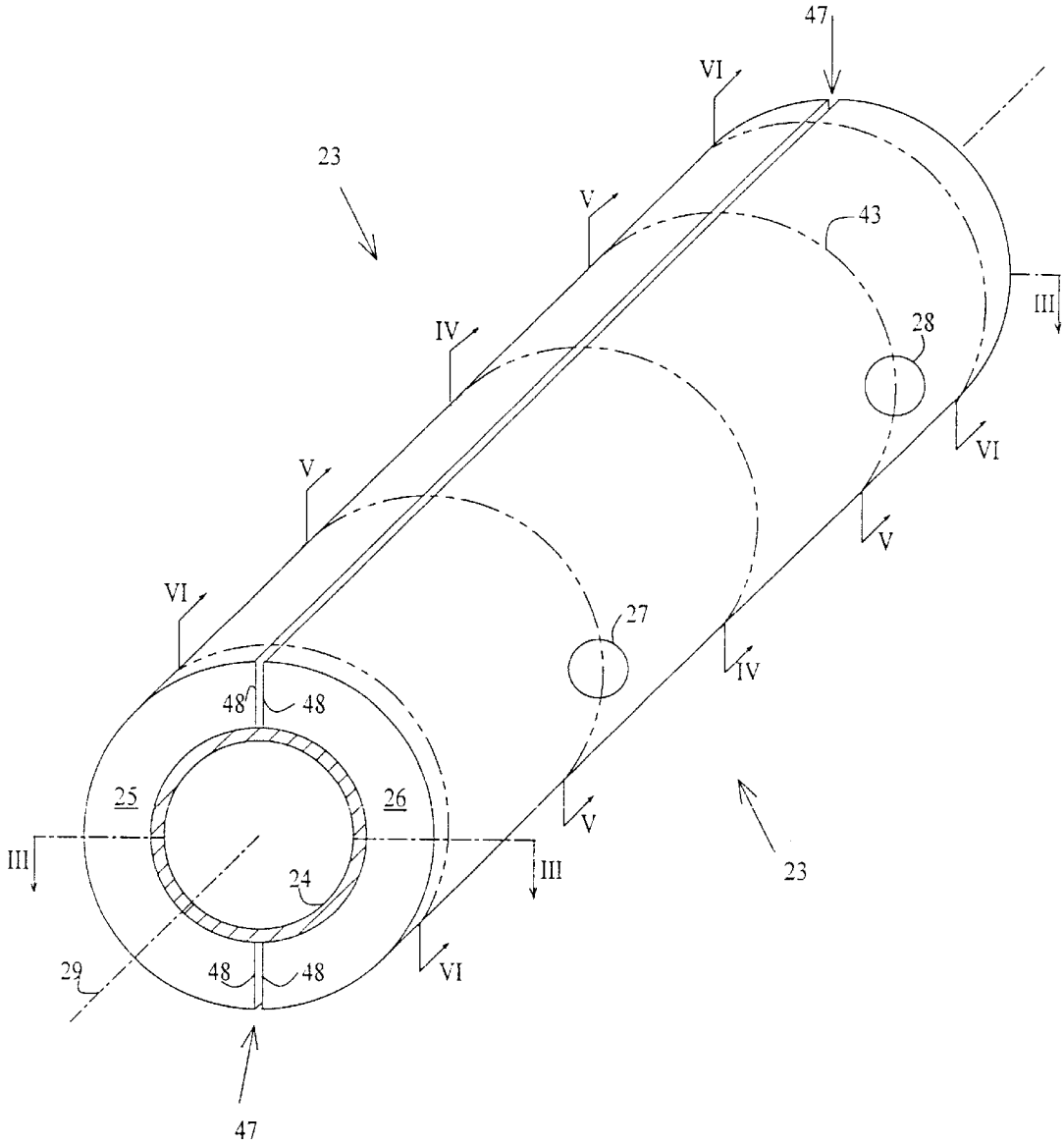
FIG. 2 is a perspective view of a pair of the composite refractory insulating tiles of the invention.

FIG. 2 is a perspective view of a pair of elongated composite refractory insulating tiles of the invention. The pair of tiles, consisting of two "C" shaped sections, are assembled end to end along the fluid-cooled furnace members as depicted in FIG. 1. Gaskets, not shown, can be provided between longitudinal ends of adjacent pairs of tiles to provide a seal and to allow for thermal expansion and contraction.

In FIG. 2 a pair of insulating tiles 23 is disposed about fluid-cooled furnace member 24. In the embodiment shown, the pair of tiles 23 is made up of two mating "C" shaped tiles 25 and 26 so as to facilitate installation. Cavities 27 and 28 extending radially inward from an outer surface of the tile toward fluid-cooled furnace member 24 provide access for welding attachment assemblies (described below), which are embedded in the tiles, to the metal fluid-cooled furnace members during installation. The cavities can be filled with a refractory mortar following completion of installation. In a preferred embodiment, access to the attachment assemblies is configured to enable use of a mig-welder as described in U.S. Pat. No. 4,424,027, having the same assignee as the present application, and the contents of which are incorporated herein by reference. Placement and number of the attachment assemblies can vary and are dependent on specifics of the installation. In FIG. 2, for clarity, solely an outer surface of the pair of tiles is shown. Cross sectional drawings of the tiles, taken in a plane containing longitudinal axis 29 and indicated at III—III, and planes perpendicular to longitudinal axis 29 and indicated at IV—IV, V—V and VI—VI show internal details of the tiles in FIGS. 3–8.

Figure 3:
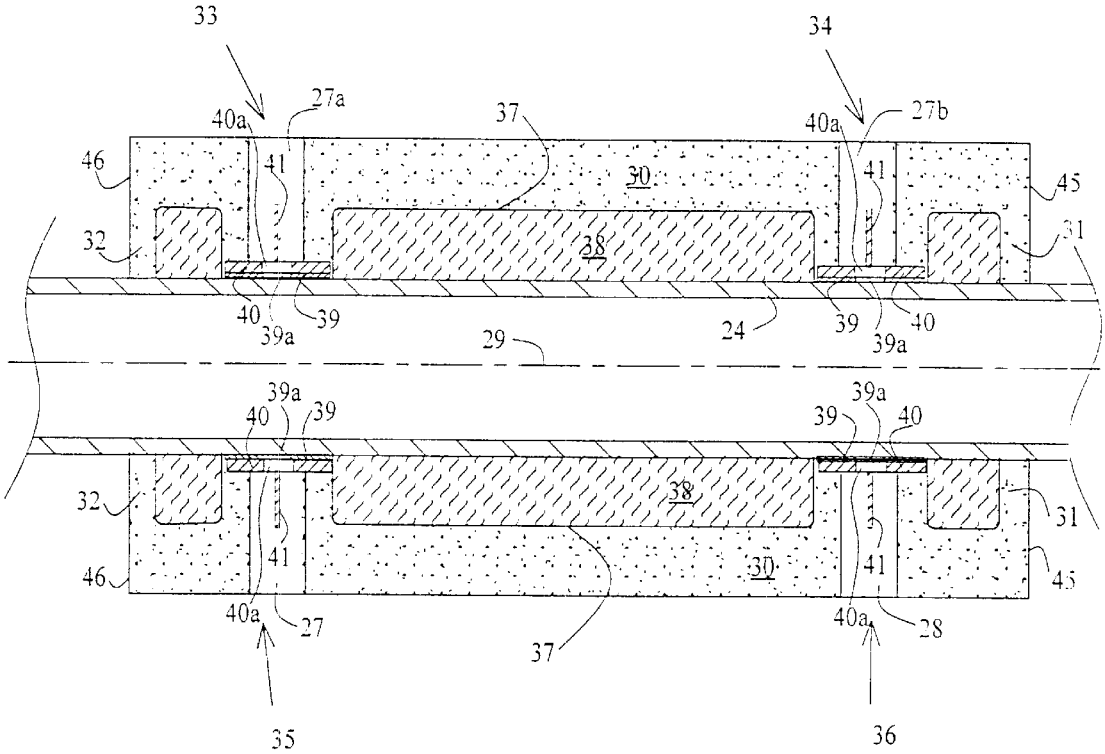
FIG. 3 is a longitudinal sectional view of a pair of the composite refractory insulating tiles of the invention in a plane indicated at section line III—III of FIG. 2.

FIG. 3 is a longitudinal cross-sectional view of a pair of tiles in a plane containing longitudinal axis 29 and indicated as III—III in FIG. 2. The plane passes through attachment assemblies associated with cavities 27 and 28, and the plane longitudinally divides the pair of tiles in half. Attachment assemblies opposed to those at cavities 27 and 28 and indicated as 27*a* and 28*a* are also shown.

Each tile includes a rigid cast refractory shell 30 adapted to be disposed about fluid-cooled furnace member 24. In a preferred embodiment of the invention, rigid cast refractory shell 30 contacts furnace member 24 solely near each longitudinal end wall 31 and 32 of the shell and in an area of each of the attachment assemblies 33, 34, 35, and 36. An inner face of the cast refractory shell 30 defines a hollow 37 which is filled with a ceramic fiber insulating blanket 38. Blanket 38 contacts furnace member 24 at portions not contacted by cast refractory shell 30.

In a preferred embodiment fiber blanket 38 is an alumina-silica ceramic fiber blanket sold as CERABLANKET by Thermal Ceramics Co. Outer shell 30 is a cast refractory material such as alumina-silica, sold as "MIX 200" by Sil-Base Co. Inc. Ceramic fiber blanket 38 has a higher insulating value (k value) than the cast refractory material, and the composite tile of the invention is thus a better insulator than a tile of similar total thickness, which is fabricated solely of the cast refractory material. Use of solely the fiber blanket 38, with its superior insulating properties is prohibited, due to the adverse effects on the blanket which would be caused by the harsh environmental conditions in the furnace, referred to above. Outer cast refractory shell 30 protects the better insulating ceramic fiber blanket 38, which is radially inward of the cast refractory shell.

The concentrically layered structure of the composite tile is described in U.S. Pat. No. 6,179,610, having the same assignee as the present application, and the contents of which are incorporated herein by reference.

Figure 4:
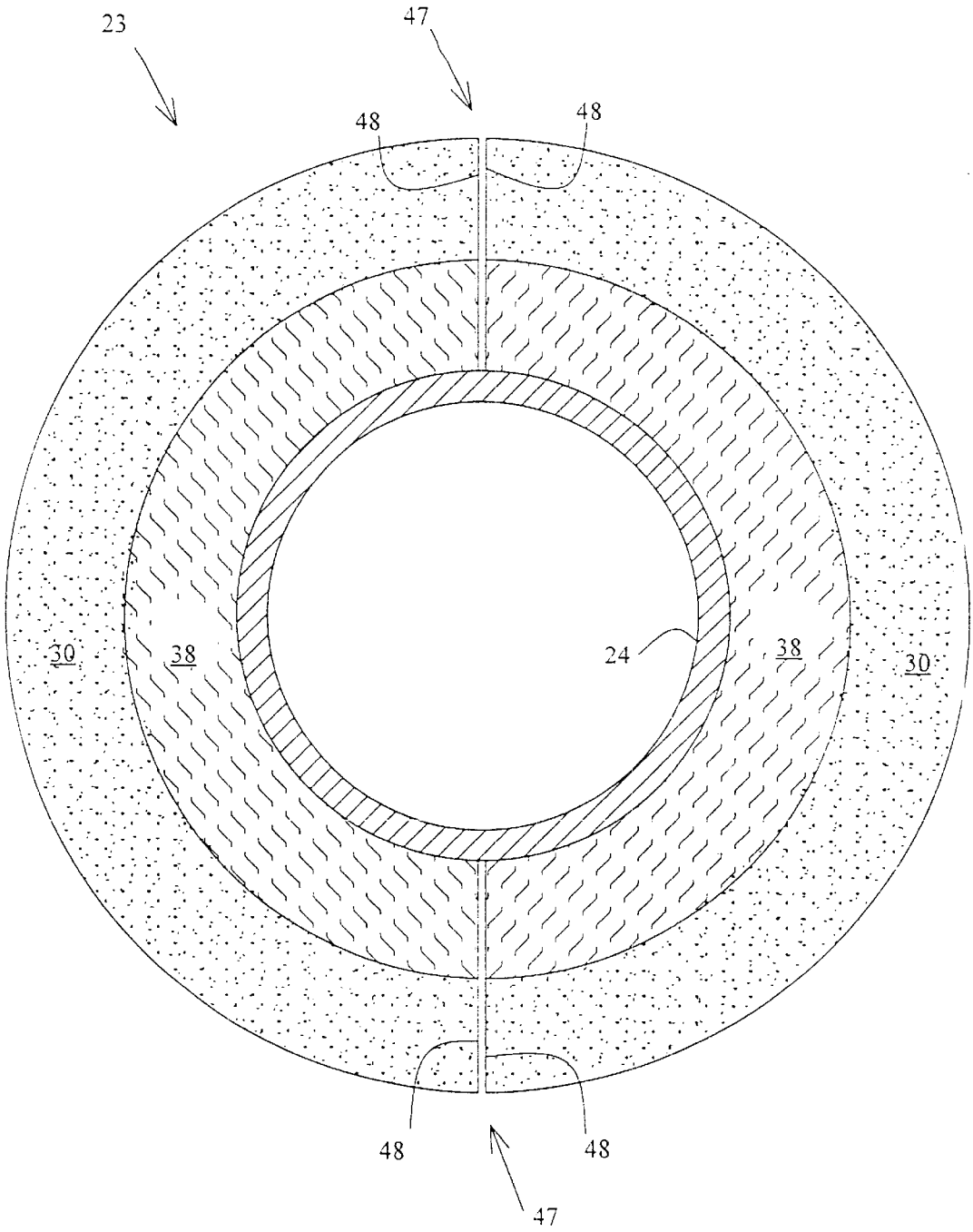
FIG. 4 is a cross sectional view of a pair of the composite refractory insulating tiles of the invention in a plane indicated at section line IV—IV of FIG. 2.

FIG. 4 is a cross sectional view of a pair of tiles of the invention in a plane perpendicular to longitudinal axis 29 which is indicated as IV—IV in FIG. 2. The portion of the pair of tiles depicted in FIG. 4 is indicative of the tiles at portions of the tiles which are longitudinally spaced from end walls 31 and 32 (FIG. 3), and also spaced longitudinally from the attachment assemblies 33–36 for attaching the tiles to furnace member 24 (described in more detail below). Referring to FIG. 4, the tiles consist of insulating ceramic fiber blanket 38 arranged to encompass and contact fluid cooled furnace member 24 and cast refractory shell 30 which encompasses the insulating fiber blanket. The portion of the tile shown in FIG. 4 is similar to those tiles known in the art, wherein a layered structure extends uniformly from one end to the other end of the tile. The composite tiles of the present invention differ however at portions of the tiles in the area of the attachment assemblies and in portions near each longitudinal end as will be more fully described below.

Figure 5:
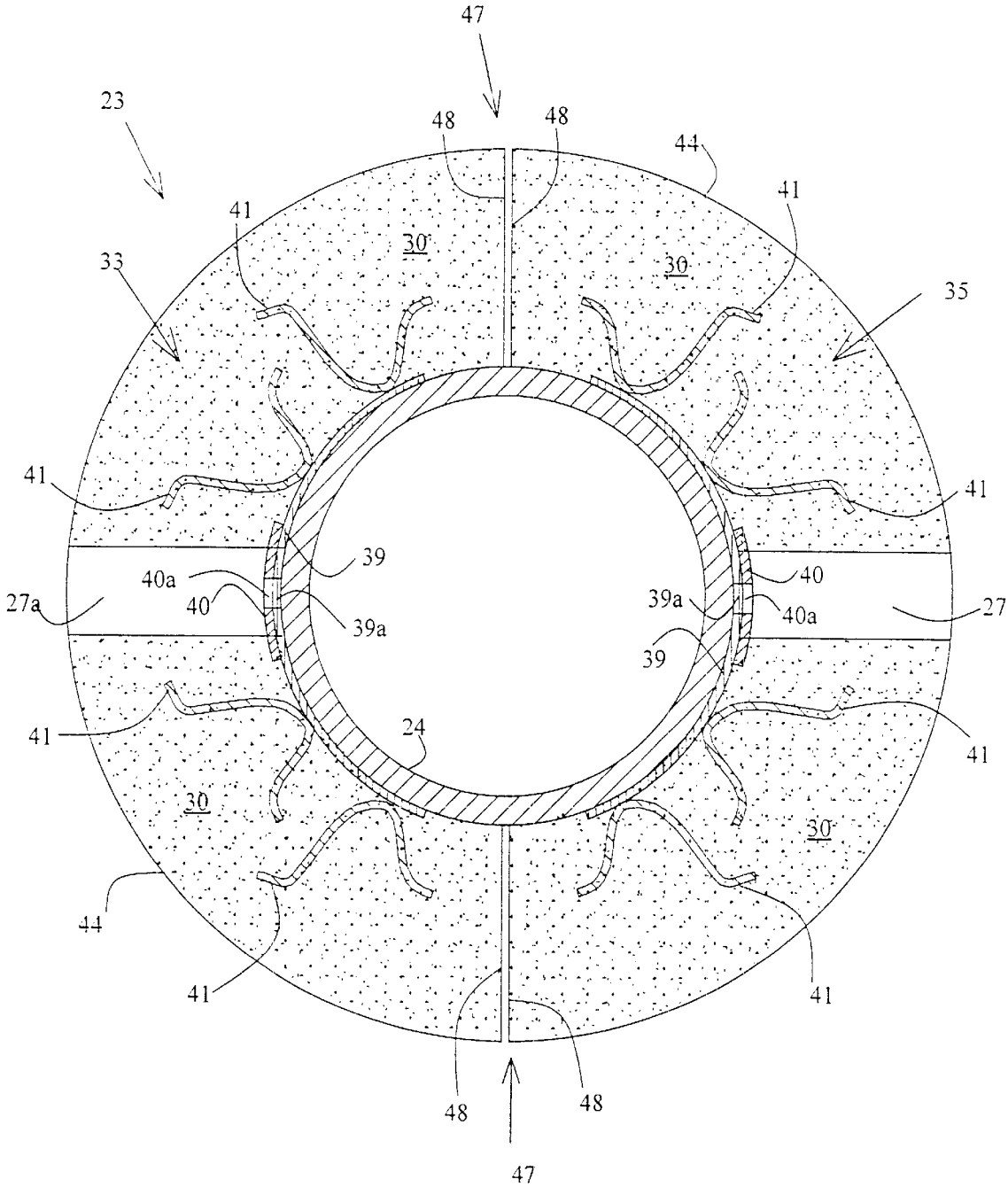
FIG. 5 is a cross sectional view of a pair of the composite refractory insulating tiles of the invention in a plane through attachment assemblies indicated at either of section lines V—V of FIG. 2.

FIG. 5 depicts the configuration of the tile in the immediate area of each attachment assembly such as 33 to 36. Cross section lines V—V, indicated in FIG. 2, define planes perpendicular to longitudinal axis 29 and passing through attachment assemblies associated with cavities 27 and 28 as well as cavities opposed to 27 and 28, which are shown in FIG. 3. Since both sections are similar, only the section associated with cavity 27 is shown in FIG. 5. Referring to FIG. 5, attachment assemblies 33 and 35 are embedded in cast refractory shell 30 and are positioned so as to contact fluid cooled furnace member 24 when the tiles are installed on furnace member 24. In the area of each attachment assembly, and circumferentially from each attachment assembly, cast refractory shell 30 extends radially inward as a protrusion of the refractory shell, to contact furnace member 24. In portions of the tiles which are longitudinally removed from the areas of the attachment assemblies, the cast refractory shell has only an outer protective shell and the hollow 37 between cast refractory shell 30 and member fluid cooled furnace 24 is filled with ceramic fiber blanket 38 as depicted in FIG. 4 and as seen between attachment assembly portions in FIG. 3. The configuration of FIG. 5, wherein the attachment assemblies contact the pipe and are embedded in the cast refractory, provides a solid radial aligning mechanism for radially aligning the composite tiles with the fluid-cooled furnace members 24 as well as solidly holding the attachment assemblies. The aligning feature is contrasted with prior practice composite insulating tiles having an insulated fiber blanket which provided no solid aligning mechanism.

The attachment assembly in the preferred embodiment of the invention is a band 39, (FIGS. 3 and 5) welding plate 40 and a plurality of anchoring wires 41. Bands 39, welding plates 40, and anchoring wires 41 are preferably of stainless steel. Preferably the band 39 is about ⅛" thick material having a width of about 1 inch. The welding plates 40 are of about ¼" thick material having a generally rectangular shape with a dimension of about 1 inch by 2 inch. The anchoring wires 41 have a diameter of about 3/16". The components of each attachment assembly are welded together prior to being cast into the refractory shell 30 of the composite tile. Cavities 27 and 28, as well as opposed cavities 27*a* and 28*a*, provide access for welding each attachment assembly 33–36 to fluid-cooled furnace member 24 during installation. Welding is carried but preferably with a mig-welder, at the time of installing the tiles to furnace member 24. The bands 39 and welding plates 40 are preferably arcuately formed so as to fit closely against furnace member 24. Each band and welding plate has a hole 39*a* and 40*a* respectively, preferably about ½" in diameter. The holes are aligned with each other radially of the furnace member, when the attachment assemblies are fabricated. The holes facilitate welding the attachment assemblies to the furnace member. Following the welding operation, cavities 27, 27*a*, 28, and 28*a* are filled with a refractory insulating material. Variations in the attachment means are possible in practice of the invention and are discussed below. Positioning and the number of attachment assemblies are dependent on length of the composite tile as well as other considerations.

An important feature of the present invention is the location of the anchoring wires 41, in relation to the cast refractory material 30 and the ceramic fiber blanket 38. In order to provide for more durable tiles and more solid attachment to the furnace members it is important that the anchoring wires 41 be subject to as low a temperature as possible, and that the difference in temperature along the length of the anchoring wires be as small as possible. These objectives are achieved by providing a shape and a configuration for the anchoring wires so that the wires do not extend into portions of the cast refractory which have the ceramic fiber blanket present, radially inward from those portions.

Referring to FIG. 3, it can be seen that anchoring wires 41 are not formed or positioned so as to extend into portions of cast refractory material 30 which have ceramic fiber blanket 38 radially inward from it. In a different view, FIG. 5 shows the anchoring wires 41 embedded in the cast refractory material 30, at portions where the cast refractory material 30 extends from the furnace member 24 to its outer face 44. No portions of the cast refractory material in which anchoring wires 41 are disposed has the ceramic blanket material between it and the furnace member 24. Since the cast refractory material 30 does not insulate as well as the ceramic blanket material 38, the temperature of an end portion of the anchoring wire 41 has a temperature lower than a temperature it would have if a layer of ceramic insulating blanket were between that end portion and the furnace member 24.

Figure 6:
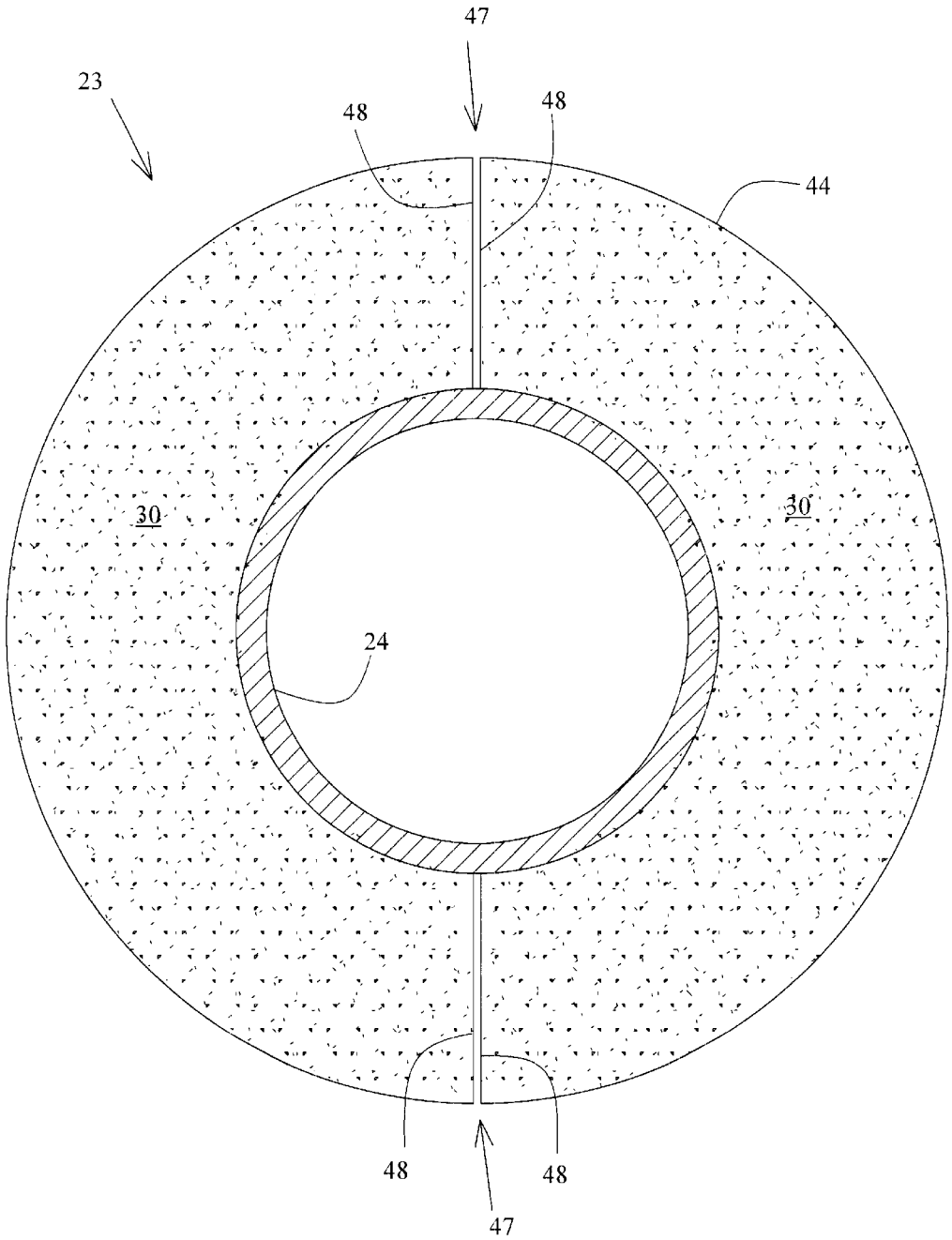
FIG. 6 is a cross sectional view of a pair of the composite refractory insulating tiles of the invention in a plane near one of its longitudinal ends which is indicated at VI—VI of FIG. 2.

FIG. 6 depicts the cross-sectional configuration of each composite tile at portions near each of its longitudinal ends. The end locations are indicated in FIG. 2 at planes VI—VI, which are perpendicular to longitudinal axis 29 of the tile. Referring to tile 23 of FIG. 6, cast refractory shell 30 extends continuously radially inward from its outer face 44 to contact fluid-cooled furnace member 24. Each cast refractory shell end portion as shown preferably extends in the direction of the longitudinal axis 29 a distance of about ¼ to ¾ of an inch inward from end walls 45 and 46 as best viewed in FIG. 3. Such cast refractory configuration is carried out at both longitudinal ends of each tile and assures proper radial alignment of the tiles relative to longitudinal axis of the fluid-cooled furnace member 24. The end aligning feature is in addition to that provided near each attachment assembly as described above with reference to FIG. 5.

The preferred embodiment of the composite tile of the invention is about 12 inches or more in length; however tiles of shorter length are possible. In a 12 inch long tile, for example, a major portion of the tile has ceramic fiber blanket 38 in contact with fluid-cooled furnace member 24 and only about 10%–30% of the composite tile contacting fluid-cooled furnace member 24 is the cast refractory shell 30. The higher proportion of ceramic fiber blanket 38 contacting the furnace member, takes advantage of the superior insulating properties of the ceramic fiber blanket, while relying on the rigidity and strength properties of cast refractory shell 30 to solidly embed the attachment assemblies and provide solid radial aligning surfaces for contact with fluid-cooled furnace member 24 when the tiles are installed.

To assure attachment assemblies 33–36 contact fluid-cooled furnace member 24, when the tile is installed, a small gap 47, up to about ¼ inch, can be configured between the "C" shaped tiles (FIGS. 2, 4, 5 and 6). The gap can be filled with refractory mortar or fiber insulation following installation, or a more flexible gasket material can be provided during installation. In the embodiment of the invention depicted in FIGS. 2–6, gap 47 is defined by edge walls 48 which extend longitudinally between end walls 45 and 46 (FIG. 3). In the preferred embodiment, the edge walls of one tile of the tile pair are in complimentary relationship with the edge walls of the remaining tile of the pair. Preferably the edge walls are planar in shape.

Figure 7:
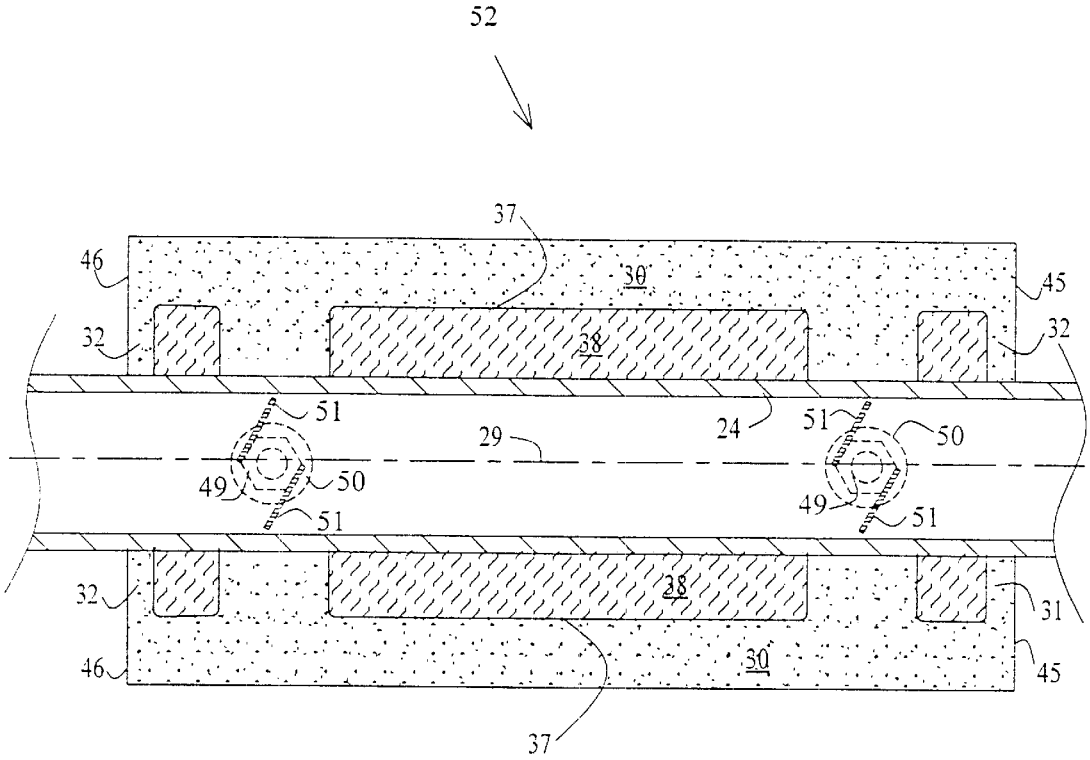
FIG. 7 is a longitudinal cross sectional view of a pair of the composite refractory insulating tiles of the invention in the plane indicated at section line III—III of FIG. 2, showing a second embodiment of the attachment assembly.
Figure 8:
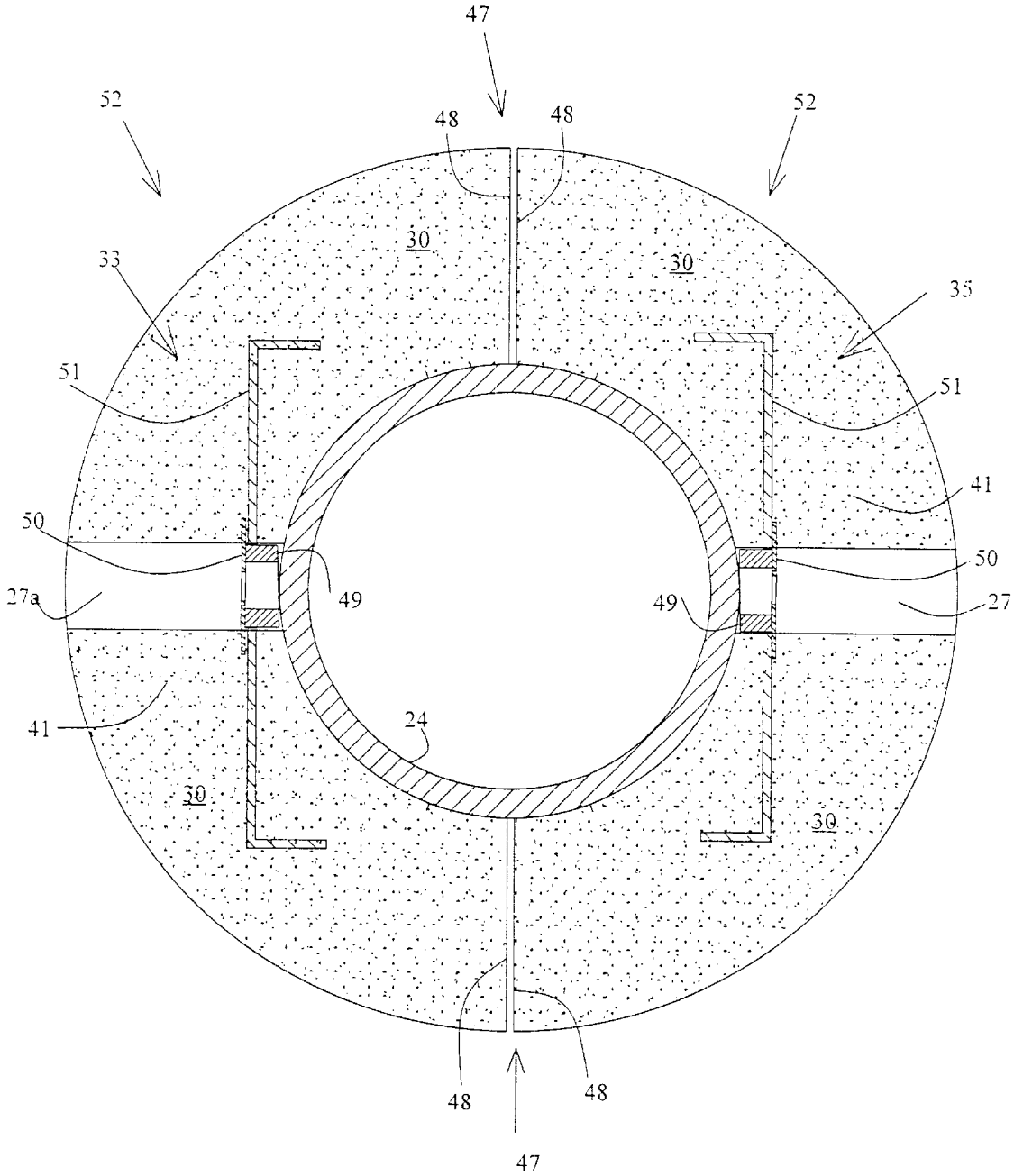
FIG. 8 is a cross sectional view of a pair of the composite refractory insulating tiles of the invention in a plane through attachment assemblies indicated at either of section lines V—V of FIG. 2, showing a second embodiment of the attachment assembly

FIGS. 7 & 8 depict a second attachment assembly embodiment of the invention. Each attachment assembly is made up of a welding base 49, washer 50, and a plurality of anchoring wires 51. In a preferred embodiment of the attachment assembly, the components are fabricated of stainless steel. As in the first embodiment, the attachment assembly enables the refractory tiles 52 to be attached to the furnace member 24 in a secure manner. Access to the attachment assembly when installing, is through access cavity 27 and 27*a* for welding the welding base 49 to the furnace member 24. As in the first embodiment, the anchoring wires 51, which are embedded in the cast refractory material, do not extend into portions of the refractory material whereat ceramic fiber blanket 38 is disposed between that portion of the cast refractory material and the furnace member 24. As in the first embodiment, such arrangement assures that the anchoring wire is at a lower temperature than that which would occur if the ceramic blanket material were present, as discussed above. As best viewed in FIG. 8, the shape of the anchoring wires can be "L" shaped, or any other shape as long as portions of the wires do not extend into portions of the cast refractory material whereat the ceramic fiber blanket is disposed between that portion of the cast refractory material and the furnace member 24.

Figure 9:
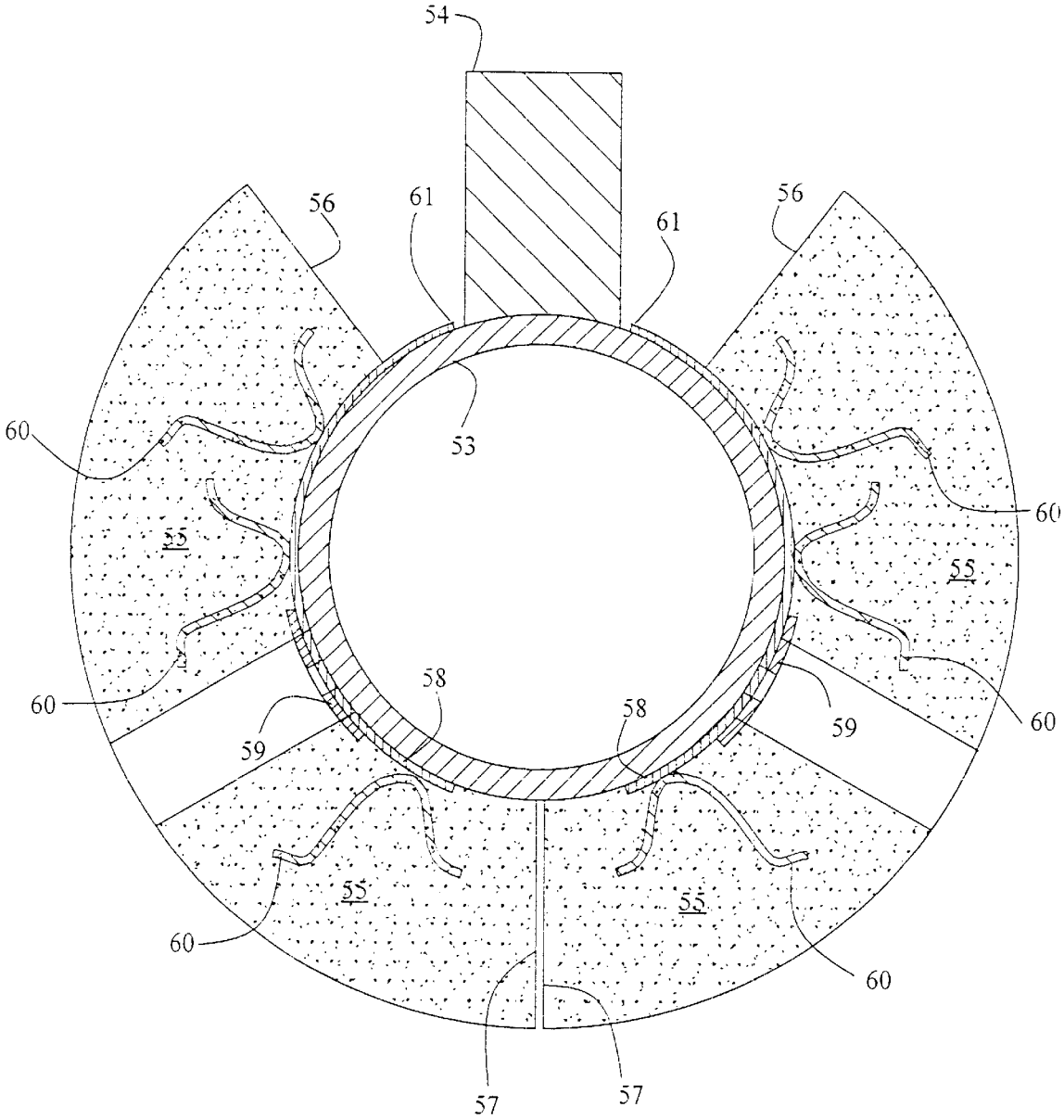
FIG. 9 is a cross sectional view, in a plane through attachment assemblies, of an embodiment of a pair of composite refractory insulating tiles of the invention for use with a fluid-cooled furnace member incorporating a skid rail projecting from its upper surface.

FIG. 9 depicts an embodiment of the pair of composite refractory tiles of the invention for use with a fluid-cooled furnace member 53 having a skid-rail wear surface 54 protruding from its upward facing outer surface. The embodiment of FIG. 9 is used for an application corresponding to that indicated by members 6 and 7 shown in FIG. 1. The embodiment disclosed in FIGS. 2–6 is used on water-cooled members such as 14–19 of FIG. 1.

The embodiment of FIG. 9 is shown in cross section in the immediate area of attachment assemblies, where cast refractory shell 55, extends radially inward as a protrusion of the cast shell, to contact fluid cooled furnace member 53. At other portions of each composite tile (not shown), which are longitudinally removed from the portions having attachment assemblies, it is configured similar to that shown in FIGS. 4 and 6; that is, the cast refractory contacts fluid-cooled furnace member 53 at each longitudinal end of each tile, and the fiber blanket contacts fluid-cooled furnace member 53 at remaining portions of each tile. In the embodiment of FIG. 9 the edge wall 56 of each tile, is chamfered to avoid any contact with the steel slab while the remaining edge wall 57, for each tile of the pair, is in complimentary relationship with the remaining edge wall 57 of the remaining tile of the pair. As in the furnace member embodiment shown in FIGS. 2–6, the present embodiment attachment assemblies have bands 58 which closely contact furnace member 53, welding plates 59, and anchor wires 60 which are embedded in the cast refractory shell 55.

In addition to welding the attachment assembly to the furnace member 53 with use of welding plates 59, bands 58 can be welding to the furnace member at ends 61 which can extend beyond the cast refractory material 55.

Although the attachment assemblies shown in FIG. 9 are that utilizing band 58, the attachment assembly described and shown in FIGS. 7 and 8 can be used with the refractory tiles for use with furnace members having skid-rail wear surface 54. Also, as in the previous embodiments, the anchoring wires do not extend into portions of the cast refractory material having the ceramic insulating blanket located radially inward from it.

In all of the embodiments described above, the thickness of the insulating fiber blanket in the radial direction is preferably in the range between about ½ and 2 inches; and the thickness of the cast refractory shell in the radial direction is preferably in the range between about ½ and 2 inch, in portions where it does not extend radially inward to contact the fluid cooled furnace member.

Each composite refractory tile of the pair of refractory tiles is preferably produced by first casting the cast refractory in a mold having a casting cavity comprising a suitable mold outer wall and an opposed mold inner wall which conforms to the shape of the fluid-cooled furnace member to which the tile is to be installed. The inner wall of the mold can incorporate inserts or raised portions, facing the casting cavity, which correspond in shape to the hollow portion of the cast refractory in which the fiber blanket is positioned. The attachment assemblies of each tile are temporarily held in proper position within the mold until solidly embedded in the cast refractory. Following casting and at least partial curing of the refractory, the cast refractory shell is removed from the mold and a final curing is carried out. In the final step, ceramic fiber blanket of a selected thickness is cut to size and fitted into the hollow portion created during casting by the mold inserts or raised portions incorporated in the inner wall of the mold.

A second method of producing the composite refractory tile comprises cutting pieces of fiber blanket to the proper shape and placing them against an inner wall mold which conforms to the shape of the fluid-cooled furnace member to which it is to be installed; placing a mold outer wall in proper position to form a casting cavity; and casting the cast refractory.

Figure 10:
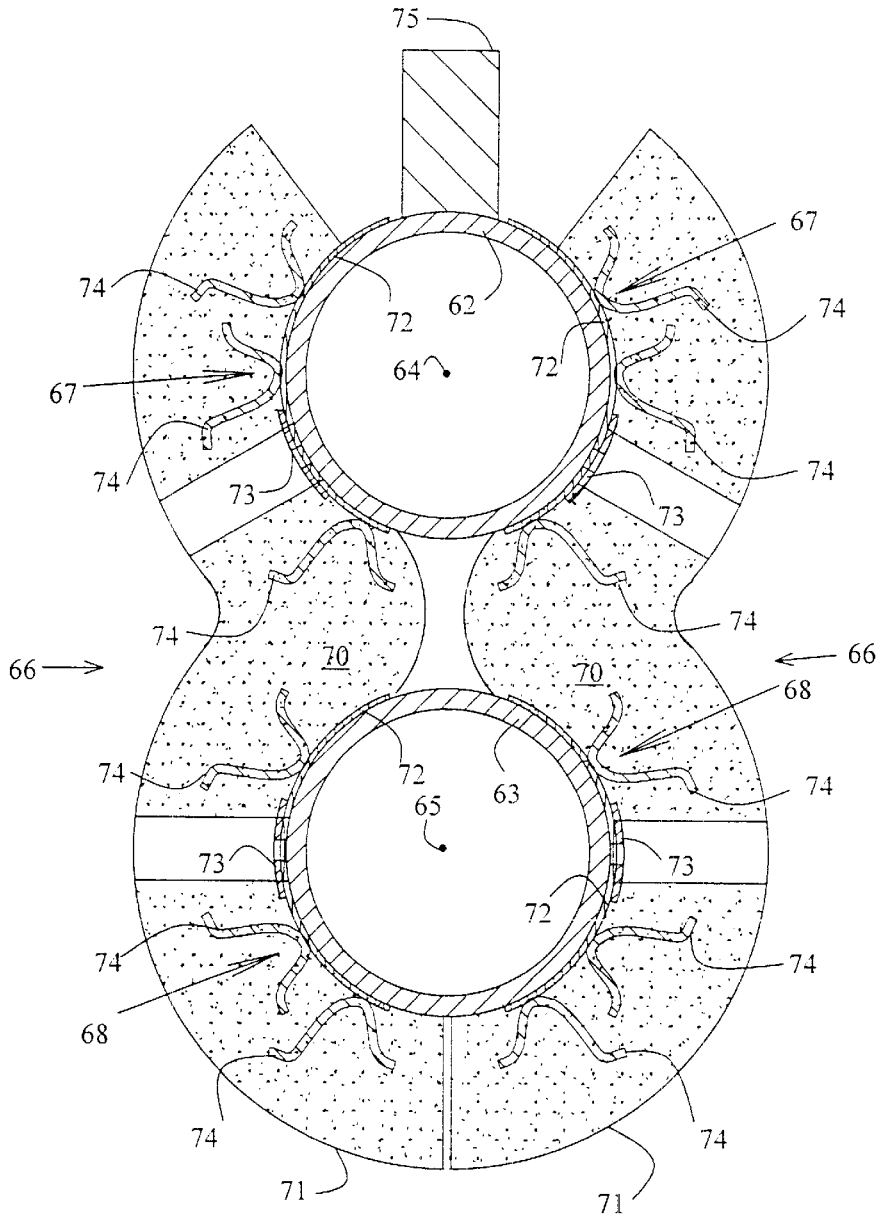
FIG. 10 is a cross sectional view, in a plane through attachment assemblies, of a pair of composite refractory insulating tiles of the invention for use with fluid-cooled furnace members arranged in a close parallel relationship.

In some furnaces in which the composite refractory tiles of the invention are used, the furnace has two fluid-cooled furnace members wherein the two members are in close relationship, and their longitudinal axes are parallel to each other. Referring to FIG. 10, fluid-cooled furnace members 62 and 63, having longitudinal axis 64 and 65 respectively, are disposed in a parallel relationship. A pair of composite refractory tiles 66 and 66 are shown in a cross-sectional view in a plane perpendicular to axes 64 and 65 in a portion through attachment assemblies 67 and 68. At portions of each tile, located longitudinally removed from the attachment assemblies, the cast refractory shell has only an outer protecting shell 70, and hollows between cast refractory shell 70 and fluid-cooled furnace members 62 and 63 are filled with a ceramic fiber blanket as described above in relation to FIG. 4. At end portions of each tile, the cast refractory shell 70 extends from the outer surface 71 to fluid-cooled furnace members 62 and 63 as in the other arrangement of furnace members as shown in FIG. 6. As in embodiments for those arrangements, the present embodiment has attachment assemblies having bands 72 which closely contact fluid-cooled furnace members 62 and 63, welding plates 73, and anchor wires 74 which are embedded in the cast refractory shell 70. As in the other embodiments, the anchoring wires 74 do not extend into portions of the cast refractory material whereat the ceramic fiber blanket is radially inward from it. The top fluid-cooled furnace member 62, in the present arrangement can include skid rail 75.

Figure 11:
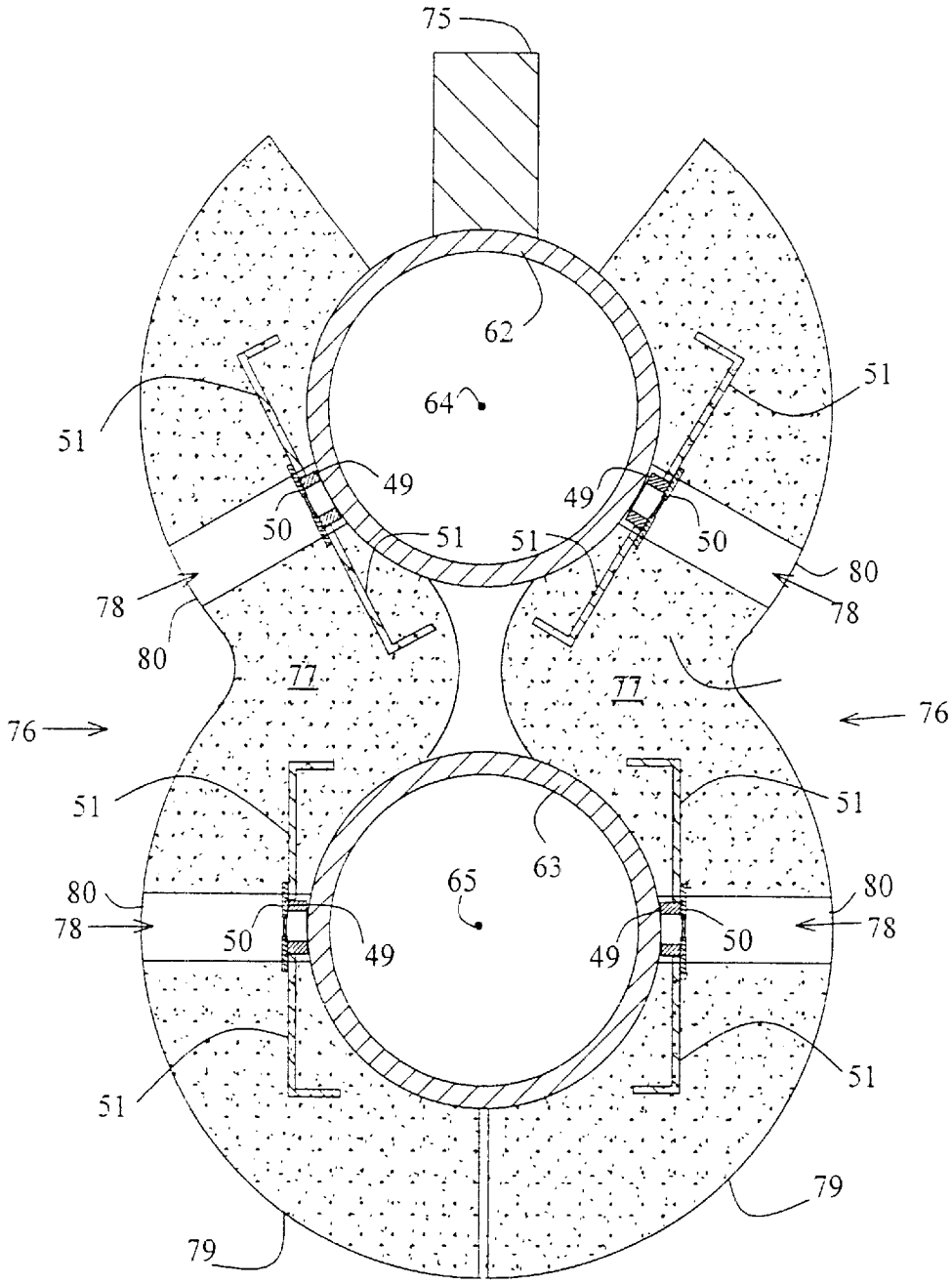
FIG. 11 is a cross sectional view, in a plane through attachment assemblies, of a pair of composite refractory insulating tiles of the invention for use with fluid-cooled furnace members arranged in a close parallel relationship, showing a second embodiment of the attachment assembly.
Figure 13:
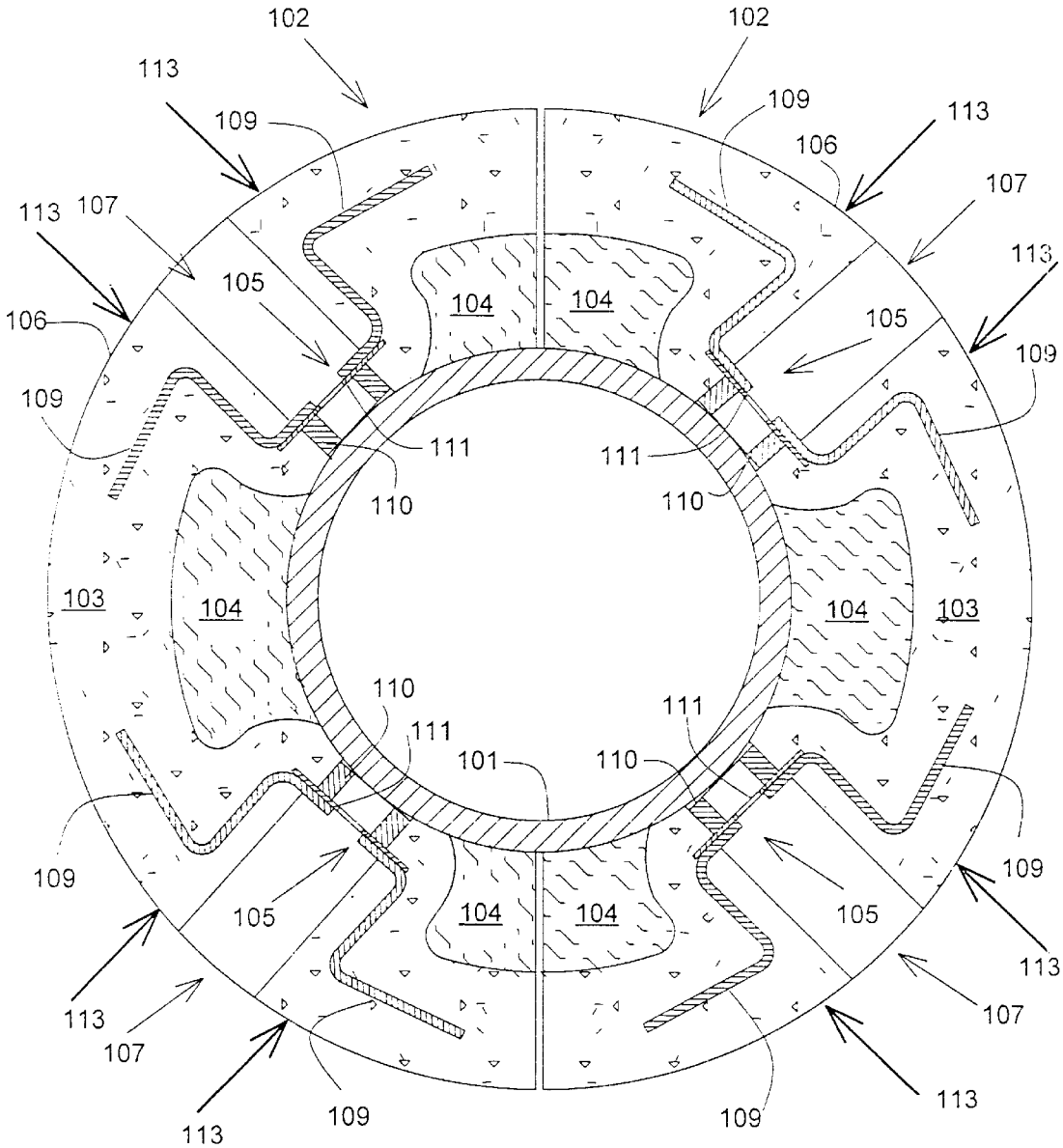
FIG. 13 Prior Art
FIG. 13 is a cross sectional view, in a plane through an attachment, of a prior art composite refractory insulating tile.
Figure 14:
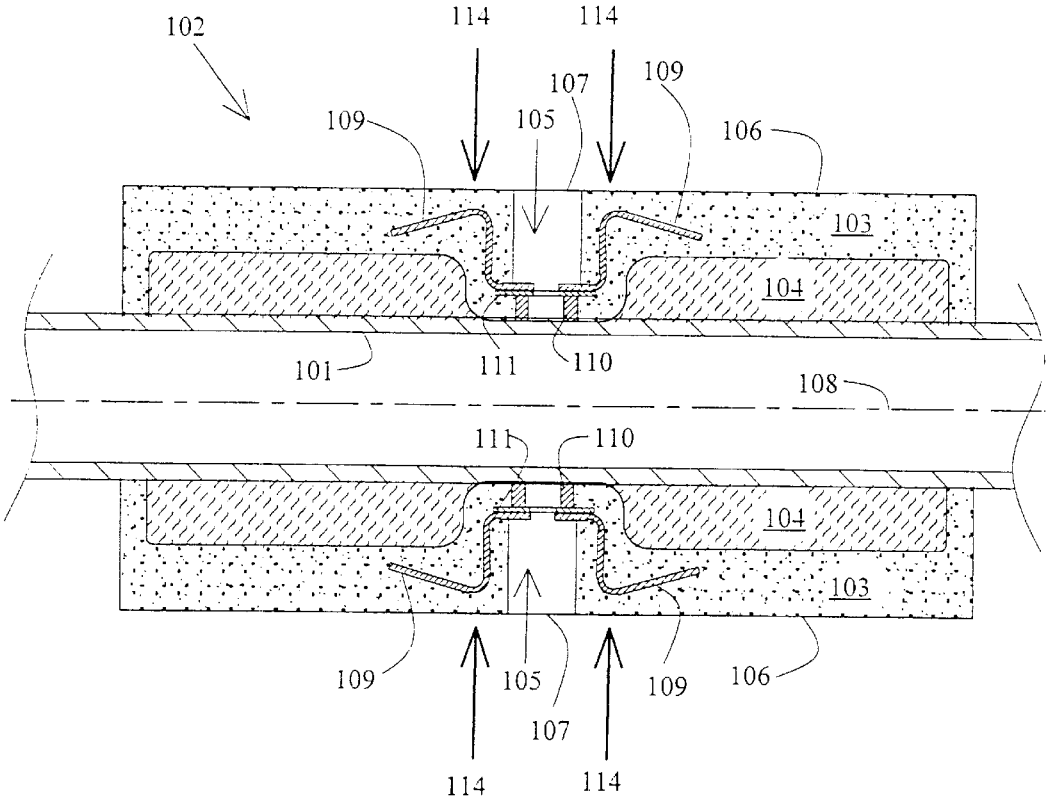
FIG. 14 Prior Art
FIG. 14 is a cross sectional view, in a plane which includes the longitudinal axis, of a prior art composite refractory insulation tile.

FIG. 11 depicts the fluid cooled furnace member arrangement described in relation to FIG. 10, however, an attachment assembly, wherein base 49, washer 50, and anchoring wires 51 are provided, is depicted. In the embodiment of FIG. 11, composite refractory tiles 76 have cast refractory portions 77 in portions of the tile, near attachment assemblies 78, which extend from tile surface 79 radially inwardly to furnace members 62 and 63. To attach the tiles to the furnace members 62 and 63, welding bases 49 are welded to the furnace members utilizing access cavities holes 80. As in previously described embodiments, the anchoring wires 51 do not extend into portions of the cast refractory material whereat a ceramic fiber blanket is present radially inward from any portion of the anchoring wire.

FIGS. 12*a*–12*f* depict various configurations for attachment assemblies having a band, in both a plan view of the band and an edge view of the band. The attachment assemblies shown in FIGS. 12*a*–12*f* are configured for use in attaching the composite refractory insulating tiles to the fluid-cooled furnace members in a non-welding manner, such as with use of a bolt and nut or other fastener means. In each of the figures, the band is indicated at reference number 81 and the anchoring wires, which are fixed to the bands, are indicated at reference number 82. The bands, in addition to having a portion, which contacts the fluid-cooled furnace member, have a portion extending radially outward for back-to-back assembly with a comparable portion of a similar band embedded in the other tile of the pair of tiles. Two types of apertures are shown as being provided, hole 83 and slot 84. Use of the slotted embodiment enables a bolt, to which a nut is already partially threaded, to be used during the installation procedure. Shapes other than those shown for the anchoring wires in FIGS. 12*a*–12*f* are possible. With use of the non-welded attachment assemblies, welding plates are not provided as part of the attachment assembly.

While specific materials, dimensional data, and fabricating steps have been set forth for purposes of describing embodiments of the invention, various modifications can be resorted to, in light of the above teachings, without departing from applicant's novel contributions; therefore in determining the scope of the present invention, reference shall be made to the appended claims.

What is claimed is:

1. A pair of composite refractory tiles for use in insulating an elongated fluid-cooled furnace member of a metallurgical furnace, each tile comprising a rigid cast refractory shell adapted to be disposed about a portion of the fluid-cooled furnace member, said shell having an inner face and an opposed outer face, opposed end walls corresponding to the longitudinal direction of the elongated fluid-cooled furnace member, and two edge walls extending between said end walls, said inner face having selected portions for contacting the fluid-cooled furnace member, and remaining portions for being radially spaced from the fluid-cooled furnace member and thereby defining a hollow;

a ceramic fiber blanket disposed within said hollow, material of said ceramic fiber blanket having a higher insulating k value than material of said cast refractory shell; and at least one attachment means disposed in selected portions of said rigid cast refractory shell, each said attachment means being so constructed and arranged so as to be disposed within portions of said cast refractory shell having temperatures lower, when in use, than temperatures of remaining portions radially spaced from the fluid-cooled furnace member and having said ceramic fiber blanket disposed in said defined hollow.

2. A pair of composite refractory tiles according to claim 1, wherein said attachment means comprises at least one attachment assembly disposed in at least one of said selected portions of said rigid cast refractory shell for contacting the fluid-cooled furnace member, said attachment assembly having a contacting portion for contacting the fluid-cooled furnace member, and a plurality of anchoring wires extending into said rigid cast refractory shell solely at portions having said rigid cast refractory shell extending from said outer face radially inward to said inner face for contacting the fluid-cooled furnace member.

3. A pair of composite refractory tiles according to claim 2, wherein selected portions of the rigid cast refractory shell for contacting the elongated fluid-cooled furnace member include one at each end wall of the cast refractory shell.

4. The pair of composite refractory tiles according to claim 2 wherein said ceramic fiber blanket has a thickness in the radial direction in the range of about ½ to 2 inches.

5. The pair of composite refractory tiles according to claim 2, wherein the rigid cast refractory shell has a thickness in the radial direction in range of about ½ to 2 inch in portions for being radially spaced from the elongated fluid-cooled furnace member.

6. The pair of composite refractory tiles according to claim 2, wherein the elongated fluid-cooled furnace member to be insulated is a cylindrically shaped pipe, the pair of refractory tiles are adapted to extend 360° circumferentially around the pipe and each one of said pair of refractory tiles has two edge walls for complimentary relationship with two edge walls of the other of said pair of refractory tiles.

7. The pair of composite refractory tiles according to claim 6, wherein said refractory tiles are configured such that when attached to the fluid-cooled furnace member, at least one complimentary edge wall of one of said pair of refractory tiles is spaced from at least one complimentary edge wall of the other of said pair of refractory tiles a distance of about ⅛ to ⅜ of an inch.

8. The pair of composite refractory tiles according to claim 2, wherein the elongated fluid-cooled furnace member to be insulated is a cylindrically shaped pipe incorporating a skid rail surface, the pair of refractory tiles are adapted to extend circumferentially around the pipe less than 360° so as to expose the skid rail surface, and each refractory tile of said pair of refractory tiles has one edge wall for complimentary relationship with one edge wall of the other of said pair of refractory tiles.

9. The pair of composite refractory tiles according to claim 2, further comprising a welding access cavity, associated with each attachment assembly of each refractory tile, extending radially through the rigid cast refractory shell from the inner face to the outer face of the refractory tile.

10. The pair of composite refractory tiles according to claim 9, wherein dimensions of each said welding access cavity are selected to enable use of a mig-welder to weld the attachment assembly to the fluid-cooled furnace member.

11. A pair of composite refractory tiles for use in a metallurgical furnace for insulating two fluid-cooled elongated furnace members having longitudinal axis arranged in parallel relationship to each other, each refractory tile comprising a rigid cast refractory shell adapted to be disposed about a portion of the fluid-cooled furnace members, said shell having an inner face and an opposed outer face, opposed end walls corresponding to the longitudinal direction of the elongated furnace members, and two edge walls extending between said end walls, said inner face having selected portions for contacting the fluid-cooled furnace members and remaining portions for being radially spaced from the fluid-cooled furnace members and thereby defining a hollow, a ceramic fiber blanket filling said hollow, for contacting the fluid-cooled furnace members, at least one attachment assembly disposed in at least one of said selected portions of said rigid cast refractory shell for contacting at least one of said two fluid-cooled furnace members, each attachment assembly having a contacting portion for contacting the at least one of said two fluid-cooled furnace members, and a plurality of anchoring wires extending into said rigid cast refractory shell solely at portions having said rigid cast refractory shell extending from said outer face radially inward to said inner face for contacting the fluid-cooled furnace member, wherein, said two edge walls of each tile have a complimentary relationship with said two edge walls of the other of said pair of tiles.

12. A pair of composite refractory tiles for use in a metallurgical furnace for insulating two fluid-cooled elongated furnace members having longitudinal axes arranged in parallel relationship to each other, with one of said furnace members having an upward facing skid rail, each refractory tile comprising a rigid cast refractory shell adapted to be disposed about a portion of the fluid-cooled furnace members, said shell having an inner face and an opposed outer face, opposed end walls corresponding to the longitudinal direction of the elongated furnace members, and two edge walls extending between said end walls, said inner face having selected portions for contacting the fluid-cooled furnace members and remaining portions for being radially spaced from the fluid-cooled furnace members and thereby defining a hollow, a ceramic fiber blanket filling said hollow, for contacting the fluid-cooled furnace members, and at least one attachment assembly disposed in at least one of said selected portions of said rigid cast refractory shell for contacting at least one of said two fluid-cooled furnace members, each attachment assembly having a contacting portion for contacting the at least one of said the fluid-cooled furnace members, and a plurality of anchoring wires extending into said rigid cast refractory shell solely at portions having said rigid cast refractory shell extending from said outer face, radially inward to said inner face for contacting the fluid-cooled furnace member, wherein, one of the said two edge walls of each tile has a complimentary relationship with one of the said two edge walls of the other of said pair of tiles and the remaining edge wall of said two edge walls of each tile has an opposing relationship with said skid rail.

13. An insulating system for a metallurgical furnace having elongated fluid-cooled furnace members incorporating skid rails and elongated fluid-cooled furnace members absent skid rails, comprising a plurality of pairs of composite refractory tiles, each tile comprising a rigid cast refractory shell adapted to be disposed about a portion of one fluid-cooled furnace member, said shell having an inner face and an opposed outer face, opposed end walls corresponding to the longitudinal direction of the elongated fluid-cooled furnace member being insulated, and edge walls extending between said end walls, said inner face having selected portions for contacting the fluid-cooled furnace member and a remaining portion for being spaced from the furnace member and thereby defining a hollow, a ceramic fiber blanket filling said hollow for contacting the fluid-cooled furnace member; and at least one attachment assembly disposed in at least one of said selected portions of said rigid refractory shell for contacting the fluid cooled furnace member, said attachment assembly having a contacting portion for contacting the fluid cooled furnace member, and a plurality of anchoring wires extending into said rigid cast refractory shell solely at portions having said rigid cast refractory shell extending from said outer face, radially inward to said inner face for contacting the fluid-cooled furnace member, wherein the pairs of tiles are adapted to extend circumferentially less than 360° around the fluid-cooled furnace members incorporating the skid rails, are adapted to extend substantially 360° around the remaining fluid-cooled furnace members, and the end walls of each tile pair are adapted to be in complimentary relationship with end walls of adjacent pairs of tiles when installed.

14. The pair of composite refractory tiles according to any one of claims 2, 11, 12, and 13, wherein said contacting portion of said attachment assembly comprises a band at least partially circumscribing said fluid-cooled furnace member and connecting at least two anchor wires.

15. A pair of composite refractory tiles according to claim 14, further including a welding plate fixed to said band in an overlaying manner, said band and said welding plate each having a hole, and said holes being in alignment with each other in the radial direction.

16. The pair of composite refractory tiles according to any one of claims 2, 11, 12, and 13 wherein each band of each refractory tile defines at least one aperture, arranged for mating during installation with at least one like aperture in a band of the other of said pair of refractory tiles to provide a means of installing said pair of refractory tiles on said fluid-cooled furnace member with use of a fastener inserted through said two mated apertures.

17. The pair of composite refractory tiles according to any one of claims 2, 11, 12, and 13 wherein said contacting portion of said attachment assembly comprises a welding base for welding to said fluid-cooled furnace member, and a flat washer joined to said welding base, with said plurality of anchoring wires extending from said joined base and flat washer.

18. The pair of composite refractory tiles according to claim 17, wherein said welding bases for welding, defines a welding aperture in alignment in the radial direction with the aperture of said flat washer, and said aligned apertures provide an access for welding said attachment assembly to said fluid-cooled furnace member.

19. A method for fabricating a pair of composite refractory tiles for insulating elongated fluid-cooled furnace members of a metallurgical furnace, comprising, for each tile providing a mold, for casting a rigid refractory material, having an outer wall and an opposing inner wall to form a casting cavity, said inner wall conforming to a shape of the furnace member to be insulated, and incorporating raised portions facing the casting cavity to create a hollow of selected depth at selected portions of the cast refractory, positioning at least one attachment means at (a) selected location(s) within the casting cavity, whereby each said attachment means is so constructed and arranged so as to be disposed within portions of said cast refractory shell having temperatures lower, when in use, than temperatures of remaining portions radially spaced from the fluid-cooled furnace member and having said created hollow, casting the refractory in the mold, at least partially curing said cast refractory, removing the cast refractory from the mold, providing a ceramic fiber blanket of a material having a higher insulating k value than material of said cast refractory shell and of a thickness substantially corresponding to the depth of the formed hollows, cutting the blanket to correspond to the shape of the hollows, and inserting the blanket into the hollows.

20. The method for fabricating a pair of composite refractory tiles according to claim 19, wherein said raised portions of the inner wall of the mold comprise inserts attached to the inner wall of the mold and facing the casting cavity.

21. A method for fabricating a pair of composite refractory tiles for insulating elongated fluid cooled furnace members of a metallurgical furnace, comprising, for each tile providing a mold, for casting a rigid refractory material, having an outer wall and an opposing inner wall to form a casting cavity, said inner wall conforming to a shape of the furnace member to be insulated, and incorporating raised portions comprised of ceramic fiber blankets facing the casting cavity, to create a hollow of selected depth at selected portions of the cast refractory, positioning attachment assemblies at selected locations within the casting cavity, said attachment assemblies having a contacting portion for contacting the fluid cooled furnace member, and a plurality of spaced anchoring wires for extending into said casting cavity solely at portions absent said ceramic fiber blankets, casting the refractory in the mold, at least partially curing said cast refractory, and removing the cast refractory from the mold.

22. The method for fabricating a pair of composite refractory tiles according to any one of claims 19, 20, and 21, wherein said contacting portion of said attachment assembly comprises a band at least partially circumscribing said fluid-cooled furnace member and connecting at least two anchoring wires.

23. The method for fabricating a pair of composite refractory tiles according to claim 22, wherein said band further includes a welding plate fixed to said band in an overlaying manner, said band and said welding plate each having a hole, and said holes being in alignment with each other in the radial direction.

24. The method for fabricating a pair of composite refractory tiles according to claim 22, wherein each band of each refractory tile defines at least one aperture, arranged for mating during installation with at least one like aperture in a band of the other of said pair of refractory tiles to provide a means of installing said pair of refractory tiles on said fluid-cooled furnace member with use of a fastener inserted through said two mated apertures.

25. The method for fabricating a pair of composite refractory tiles according to any one of claims 19, 20, and 21, wherein said contacting portion of said attachment assembly comprises a welding base for welding to said fluid-cooled furnace member, and a flat washer joined to said welding base, with said plurality of anchoring wires extending from said joined base and flat washer.

26. The method for fabricating a pair of composite refractory tiles according to claim 25, wherein each said welding base for welding defines a welding aperture in alignment, in the radial direction, with the aperture of said flat washer, and said aligned apertures provide an access for welding said attachment assembly to said fluid-cooled furnace member.

* * * * *